United States Patent [19]

Shah

[11] Patent Number: 4,666,395

[45] Date of Patent: May 19, 1987

[54] APPARATUS FOR MAKING NONWOVEN SHEET

[75] Inventor: Ashok H. Shah, Richmond, Va.

[73] Assignee: E. I. DuPont de Nemours and Company, Wilmington, Del.

[21] Appl. No.: 814,712

[22] Filed: Dec. 30, 1985

[51] Int. Cl.[4] ..... B29C 47/34; B29C 47/12

[52] U.S. Cl. ..... 425/377; 425/174.8 E; 425/382.2; 425/83.1

[58] Field of Search ..... 425/72 S, 80.1, 83.1, 425/224, 174.8 E, 377, 382.2; 264/9, 10, 24, 176 F; 65/8

[56] References Cited

U.S. PATENT DOCUMENTS 3,081,519 3/1963 Blades et al. ..... 264/5
3,169,899 2/1965 Steuber ..... 264/167
3,402,227 9/1968 Knee ..... 264/24
3,497,918 3/1970 Pollock et al. ..... 18/2.6
3,860,369 1/1975 Brethauer et al. ..... 264/22
4,537,733 8/1985 Farago ..... 264/9

*Primary Examiner*—Bernard Nozick

[57] ABSTRACT

An improved nonwoven-sheet-making apparatus includes an improved rotatable baffle which has a conical section that whose axis is displaced from the axis of rotation of the baffle. In preferred operation, the baffle deflects, spreads and oscillates a fiber stream as it advances from a spinneret to a moving receiver on which the stream fibers are deposited to form a ribbon which is overlapped with like-formed ribbons to form a sheet. The apparatus is particularly useful in making a less ropy more uniform sheet of flash-spun plexifilamentary strands.

6 Claims, 10 Drawing Figures

Fig. 2
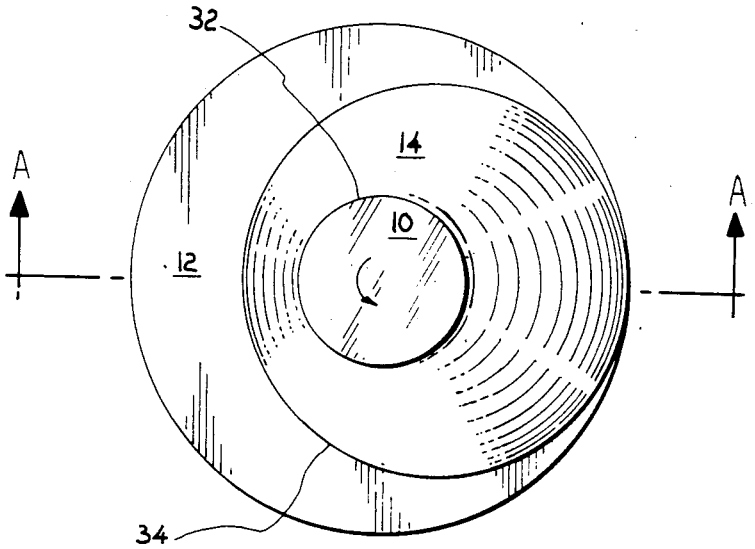
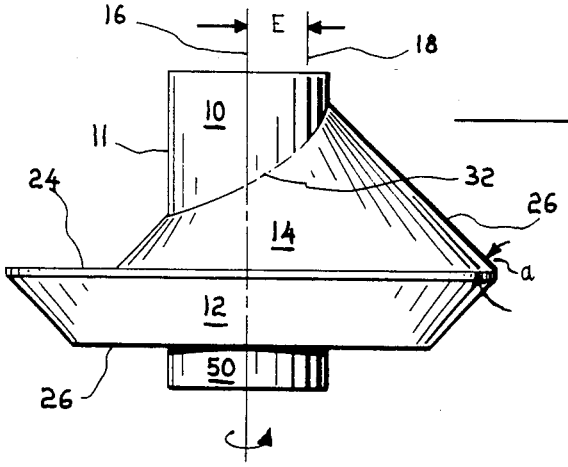
Fig. 3
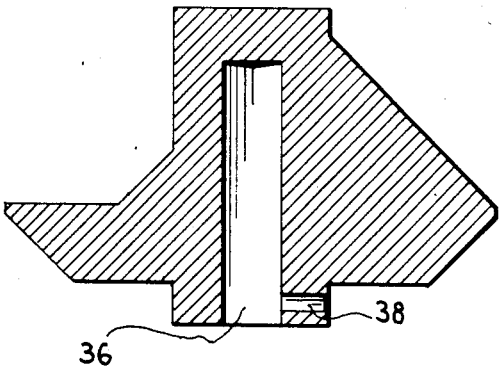
Fig. 4

0° ROTATION

90° ROTATION

270° ROTATION

180° ROTATION

APPARATUS FOR MAKING NONWOVEN SHEET

FIELD OF THE INVENTION

This invention relates to an apparatus for making nonwoven sheet, which apparatus includes a rotatable baffle that in operation deflects, spreads and oscillates a stream of fibers as the stream is forwarded to a moving receiver on which the fibers are deposited. In particular, the invention concerns such an apparatus in which the rotatable baffle features a conical portion displaced from the axis of rotation of the baffle. In operation the apparatus provides an improvement in uniformity and appearance of the resultant nonwoven sheet.

DESCRIPTION OF THE PRIOR ART

Many processes are known wherein fibers from a plurality of positions are deposited and intermingled on the surface of a moving receiver to form a wide nonwoven sheet. For example, Knee, U.S. Pat. No. 3,402,227, discloses a plurality of jets positioned above a receiver and spaced in a line that makes an angle with the direction of receiver movement so that the fiber streams that issue from the jets deposit fibers on discrete areas of the receiver to form ribbons which combine with ribbons formed from other streams along the line.

Several methods are known for directing the fibers from a plurality of positions to various locations across the width of the receiver. For example, Steuber, U.S. Pat. No. 3,169,899, discloses the use of curved oscillating baffles for spreading flash-spun plexifilamentary strands while oscillating and directing them to a moving receiver. Processes for flash-spinning plexifilamentary strand are disclosed in Blades and White, U.S. Pat. No. 3,081,519.

An efficient method for depositing fibers onto the surface of a moving receiver is disclosed in Pollock and Smith, U.S. Pat. No. 3,497,918. In a preferred embodiment of Pollock and Smith, plexifilamentary strand is flash-spun and forwarded in a generally horizontal direction into contact with the surface of a rotating lobed baffle. The baffle deflects the strand and accompanying expanded solvent gas downward into a generally vertical plane. Simultaneously, the baffle spreads the strand into a wide, thin web and causes the web to oscillate as it descends toward the receiver surface. An electrostatic charge is imparted to the web during its descent to the receiver. The web is then deposited as a wide swath on the surface of the receiver. To make wide sheet, numerous flash-spinning units of this type are employed. The units are positioned above the moving receiver surface so that the deposited swaths form ribbons which partially overlap and combine to form a multi-layered sheet.

Farago, U.S. Pat. No. 4,537,733, suggests that a multi-position apparatus of the type described in Pollock and Smith be operated with the frequency of oscillation of the fiber streams varying by more than ±5%, but less than ±50% of the average oscillation frequency. The method of Farago and the apparatus of Pollock and Smith have been very successful in the commercial production of wide nonwoven sheets prepared from flash-spun plexifilamentary strands. However, the utility of the nonwoven sheets could be much enhanced by improvements in sheet uniformity and appearance, particularly with regard to reducing the frequency and size of an undesired effect, referred to herein as "ropiness." Ropiness exhibits itself as agglomerated groups of fibers or fibrils that look like strings on the surface or within an otherwise uniform sheet. Ropiness is especially apparent when viewed with a light behind the sheet. Such nonuniformities often measure as much as 30-cm long and 1-cm wide and detract from the utility of the sheet, especially in end-uses that require printing on the sheet.

The purpose of the present invention is to provide an apparatus for making nonwoven sheet having less ropiness and improved uniformity.

SUMMARY OF THE INVENTION

The present invention provides an improved nonwoven-sheet-making apparatus. The apparatus is of the general type disclosed in Pollock and Smith, U.S. Pat. No. 3,497,918. The apparatus has a rotatable baffle for deflecting, spreading and oscillating a fiber stream, means for rotating the baffle, means for forwarding a fiber stream to the baffle, a movable receiver on which the fiber stream deposits its fibers to form a ribbon which can be lapped with like-formed ribbons to form a sheet, and means for advancing the movable receiver, the baffle having an integral body which includes a boss portion, a flat circular disc portion and a fillet portion, the boss and disc portions having a common axis which is coaxial with the axis of rotation of the baffle. The improvement of the present invention, comprises the fillet portion being a section of a cone whose slant surface intersects the boss portion, whose base is parallel to and located atop the flat circular disc portion and whose axis is displaced from the axis of rotation of the baffle. Preferably, the cone section is a section of a right cone whose axis is parallel to the axis of baffle rotation and the displacement is in the range of 0.5 to 2 cm, most preferably, 0.75 to 1.5 cm. Generally, the angle between the base of the cone portion and its slant surface is in the range of 30 to 60 degrees, preferably 40 to 50 degrees. A preferred material of construction for the baffle is a nonconductive plastic. In another preferred embodiment, the baffle contains counterweights, to provide a dynamically balanced rotation.

BRIEF DESCRIPTION OF THE DRAWINGS

The invention will be more readily understood by reference to the attached drawings wherein:

FIGS. 2, 3 and 4 respectively are a top plan view, a side view and a side view cross-section of a rotatable baffle of the invention;

DETAILED DESCRIPTION OF PREFERRED EMBODIMENTS

Figure 1:
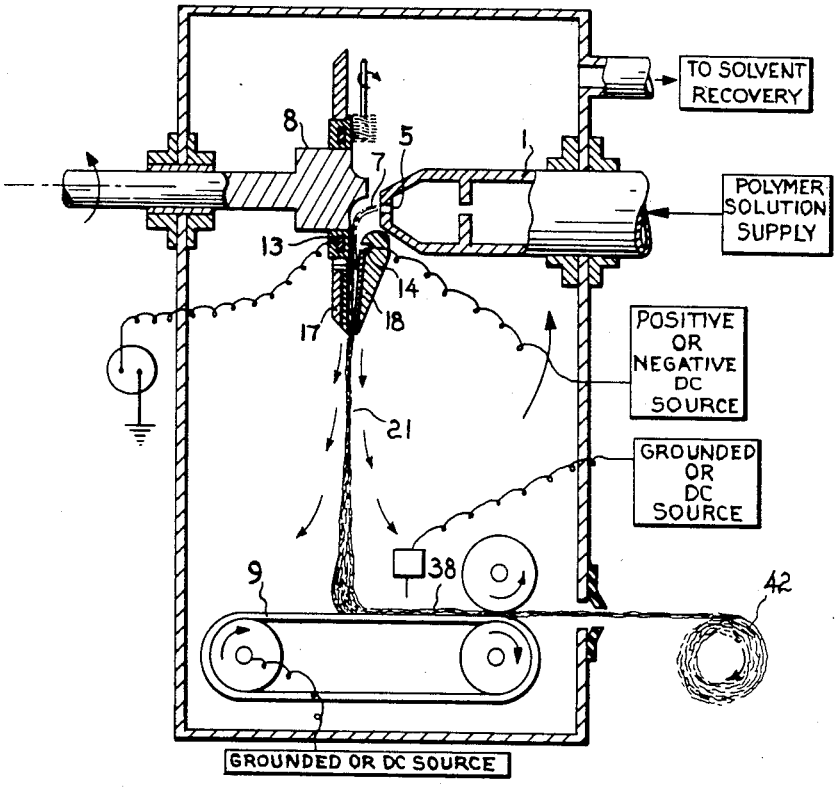
FIG. 1 is a schematic representation of a flash-extrusion apparatus for making nonwoven sheet with a rotatable baffle of the invention.
Figure 5:
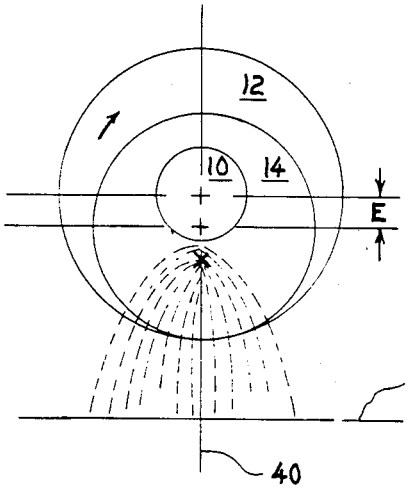
FIGS. 5, 6, 7 and 8, each being a plan view representation of the rotatable baffle in a different angular position during one complete revolution, illustrate how the fiber stream is spread and oscillated.
Figure 6:
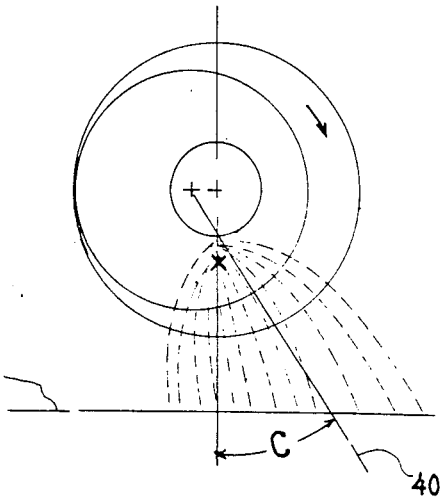
Figure 8:
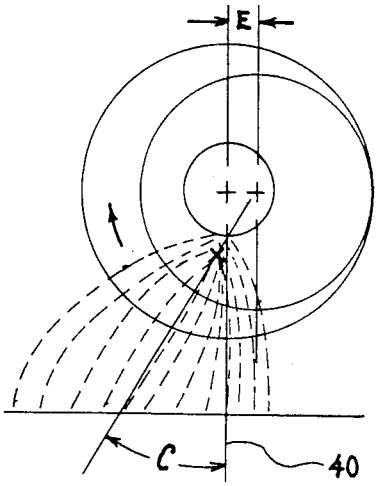
Figure 7:
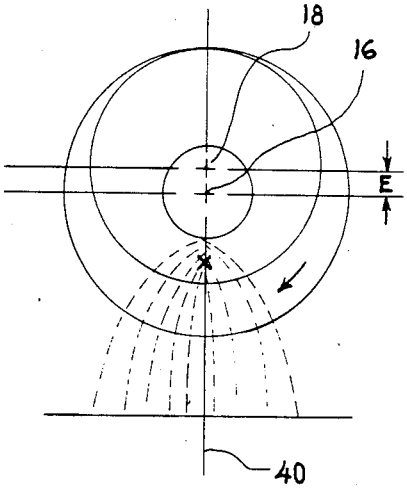

Although the invention will now be described and illustrated in detail with respect to a preferred process for manufacturing wide nonwoven sheets from flash-spun plexifilamentary strands of polyethylene, the invention is considerably broader in its application and can be used in a variety of sheet-making processes with many different types of fibers. As used herein, the term "fiber" is intended to include filaments, fibrous strands, plexifilaments, staple fibers and the like. The fibers usually are of organic polymers, but inorganic fibers, such as glass, are also suitable for use in the invention.

The general apparatus chosen for illustration of the present invention is similar to that disclosed in Farago, U.S. Pat. No. 4,537,733, the entire disclosure of which is incorporated herein by reference. As shown in that patent and more particularly in FIG. 1 herein, such a typical position generally includes a spinneret device 1, having an orifice 5, positioned opposite a rotating baffle 8, an aerodynamic shield comprised of members 13, 15, 17, and 19 located below the baffle and including corona discharge needles 19 and target plate 13, and a moving receiver 9 below the aerodynamic shield. A more detailed description of the apparatus is found in Bednarz at column 1, lines 67 through column 2, lines 64 and in Brethauer and Prideaux, U.S. Pat. No. 3,860,369 at column 3, line 41 through column 4, line 63, which descriptions are incorporated herein by reference. Each of the aforementioned incorporated references discloses a rotating baffle 8 which is lobed in accordance with Pollock and Smith U.S. Pat. No. 3,497,918. However, as described in greater detail hereinafter, the rotatable baffles of the present invention are substituted for the known lobed baffle to provide sheet of improved uniformity and less ropiness.

In operation of equipment of the type depicted in FIG. 1, a polymer solution is fed to spinneret device 1. Upon exit from orifice 5, solvent from the polymer solution is rapidly vaporized and a plexifilamentary strand 7 is formed. Strand 7 advances in a generally horizontal direction to rotating baffle 8 which deflects strand 7 downward into a generally vertical plane and through the passage in the aerodynamic shield. The rotating baffle, the action of the solvent gas and the effects of passage through the corona discharge field and the aerodynamic shield spread the strand into a thin, wide web 21 which is deposited on moving receiver 9. The displaced conical portion of rotating baffle 8 imparts an oscillation to plexifilamentary strand 7 so that the spread and deflected strand oscillates as it descends to the moving receiver. On receiver 9, the plexifilamentary web is deposited as a swath, which forms a ribbon that is combined with ribbons from other positions (not shown) to form wide sheet 38, which is then wound up as roll 42. The direction of oscillation of the descending strand is in the vertical plane that is perpendicular to the plane of the paper. Because of the oscillation, the width of the ribbon that forms on the receiver is significantly wider than the width of the spread strand itself.

A convenient method for making wide sheet with the above-described type of equipment is disclosed by Farago, U.S. Pat. No. 4,537,733, column 4, line 12 through column 5, line 38, which disclosure is hereby incorporated by reference. A plurality of flash-extrusion positions are arranged above a moving receiver in a line that is at an acute angle to the direction of movement. At each position, the fiber stream is oscillated in a plane perpendicular to the direction of receiver movement. The positions are spaced so that ribbon formed from one position is overlapped 75 to 85% by ribbon formed by the next position in the line. In this manner, a four or five layer sheet is formed. Farago further discloses varying the fiber stream oscillation frequency in the range of about ±5 to ±50% of the average oscillation frequency with a period of variation in the range of 1 to 120 seconds. Average oscillation frequency generally is in the range of 25 to 150 cycles per second. Variation of the oscillation frequency in this manner provides more uniform rolls of wound-up sheet without undesired lanes of high and low unit weight in the sheet. The baffles of the apparatus of the present invention generally are operated in substantially the same manner as disclosed by Farago.

A preferred embodiment of the rotatable baffle of the apparatus of the present invention is depicted in FIGS. 2, 3 and 4. The baffle has an integral body that includes a boss portion 10, a disc portion 12, a fillet portion 14 and a hub portion 50. Boss portion 10 and hub portion 50 usually are right circular cylinders that are coaxial with the axis of disc portion 12. Hub portion 50 is connected to surface 26 of disc portion 12. Boss portion 10 is located on the opposite side of the disc portion, as shown in FIG. 3.

Fillet portion 14 is a section of a right cone. The base of the cone is located on surface 24 of disc portion 12 and the axis 18 of the cone is parallel to the axis of baffle rotation 16, but displaced therefrom by distance "E".

Fillet portion 14 extends around boss portion 10, as shown on FIGS. 2 and 3. Fillet portion 14 intersects boss portion 10 along line 32 and disc portion 12 along line 34. Although intersections 32 and 34 are shown as distinct lines in FIGS. 2 and 3, in actual construction, fillet portion 14 merges smoothly into cylindrical surface 11 of boss 10 and into flat surface 24 of disc portion 12.

The angle "a" made by slant surface 26 of cone portion 14 with flat surface 24 of disc portion 12 is usually in the range of 30 to 60 degrees, preferably 40 to 50 degrees, and most preferably 45 degrees. When the angle is 45 degrees, changes in the fiber stream path from horizontal to vertical are smoothest (i.e., least abrupt).

The displacement "E" of axis 18 of conical portion 14 from axis of rotation 16 generally is in the range of 0.5 to 2 cm when the baffle is used in the type of multi-position flash-spinning nonwoven-sheet-making machine described above. Preferably, the displacement is in the range of 0.75 to 1.5 cm. Small displacements of conical portion axis 18 from axis of rotation 16 lead to small angles of oscillation "C"; large displacements lead to larger angle of oscillation. This effect can be seen from examination of FIGS. 5 through 8. In these figures, "X" represents the center of the area where the fiber stream impinges on the baffle. Line of symmetry 40 of the spread web extends from the central point of fiber impact "X" to axis 18 of the conical portion. Thus, as shown in FIGS. 5 through 8, each 360 degree rotation that the baffle completes results in one full oscillation of the web by ± angle "C". Generally, larger angles "C" result in wider ribbon on receiver 38 (all other things being equal).

Where the apparatus of the invention is employed with the type of equipment depicted in FIG. 1, which equipment includes an electrostatic charging device located just downstream of the baffle, the baffle is preferably made from an electrically nonconductive material. Moldable plastics are well suited for this purpose. Lucite® acrylic resin or epoxy resins are particularly preferred.

Because the conical portion of the baffle is displaced from the axis of rotation, a weight imbalance exists in the baffle which could lead to undesired vibration and equipment damage in use. Accordingly, counterweights, in the form of metal plugs, can be imbedded in the rear side 26 of disc portion 12 in order to provide dynamic balance to the baffle.

In the example below, the apparatus of the invention is tested in the manufacture of wide, nonwoven sheets made from flash-spun plexifilaments of polyethylene film fibrils. To determine the effect of the test baffles on sheet ropiness and uniformity, the ribbon formed from the fibers deposited by the position under study was separated carefully from the other layers of the sheet, by peeling-off two upper layers and two lower layers from the ribbon layer under study. Then, to determine the ropiness of the ribbon, a 1.83-meter length of ribbon was examined on a light box. The length, width and number of large string-like formations in the sheet were measured. Also, the ribbon sample was cut into equal lengths of 2.54-cm wide strips. The strips were weighed in order to determine the weight profile across the width of the ribbon. A trapezoidal profile is preferred for blending of swaths to provide a uniform weight distribution across the width of multi-layer wide sheet. Departures of the ribbon weight distribution from the preferred trapezoidal distribution lead to nonuniformities in the weight distribution across the wide sheet. If the same ribbon weight distribution is assumed for each position, the total amount of nonuniformity contributed to wide multi-layer sheet by the weight distribution within each ribbon can be computed. Particularly contributing to nonuniformities across the width of wide multi-layer sheets are bimodal distributions and skewed distributions of the weight across the width of individual deposited ribbons.

EXAMPLE

The tests described in this example illustrate the advantage obtained when operating a multi-position nonwoven-sheet-making apparatus in accordance with the present invention as compared with apparatus known in the art.

Figure 9:
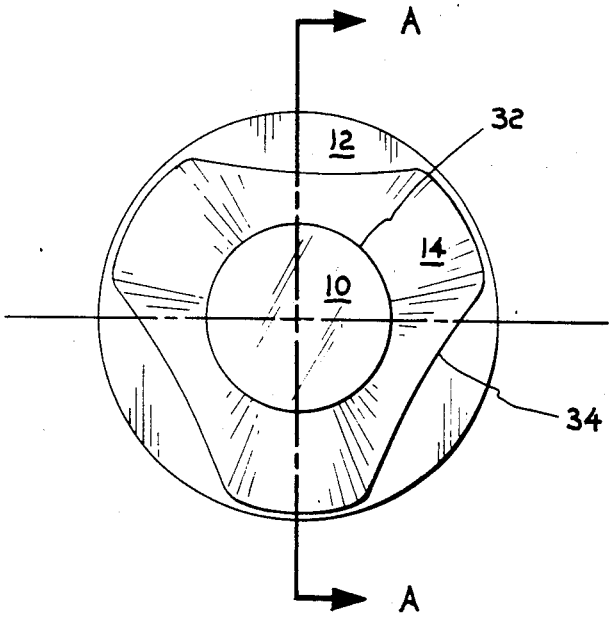
Fig. 9 (Prior Art)
FIGS. 9 and 10 respectively are a top plan view and a side view cross-section of a three-lobed rotatable baffle of the prior art.
Figure 10:
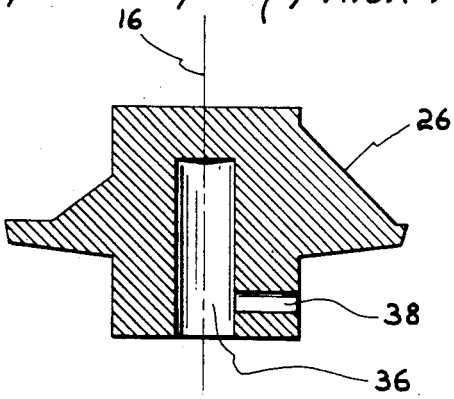
Fig. 10 (Prior Art)

The apparatus described in the Example of Farago U.S. Pat. No. 4,537,733 was employed for making the sheet of this example. All positions of the apparatus, except for the test position, were equipped with three-lobed baffles of the type illustrated in FIGS. 9 and 10 of this application. These three-lobed baffles of the art are the best known for commercial manufacture of flash-spun, polyethylene, film-fibril plexfilamentary sheet. The test position was equipped with an eccentric conical baffle in accordance with the present invention.

Each of the three-lobed baffles had a disc portion that measured 4 inches (10.16 cm) in diameter and a boss portion that measured 2 inches (5.08-cm) in diameter. The lobes extended within 0.06 inch (0.15 cm) of the edge of the disc portion. The distance from the front of the boss portion to the face of the disc portion was 1 inch (2.54 cm). Each three-lobed baffle was rotated to oscillate the spread fiber stream an average of 5150 cycles per minute with an imposed variation of ±325 cycles per minute every 30 seconds (i.e., time from minimum to maximum). The variation was imposed in a "saw tooth" fashion (i.e., the rotation speed increased and decreased linearly between maximum and minimum).

The test position contained a baffle made in accordance with the invention and as depicted in FIGS. 2 through 4. The test baffle measured 5 inches (12.7 cm) in disc portion diameter, 1.6 inches (4.06) in boss portion diameter, 3.90 inches (9.91 cm) in cone base diameter and 2 inches (5.08 cm) from the boss face to the flat surface of the disc. The slant angle of the conical portion was 45 degrees. The rotation frequency in each test was constant; 4500 revolutions per minute in test 1 and 5000 revolutions per minute in test 2.

Each of the test and prior art positions was operated in the same manner, except for the differences noted above. The center of the area of impact of each flash-spun stream upon the rotating baffle was ¼ inch (0.63 cm) below the cylindrical surface of the baffle boss. The vertical distance from that center to the moving receiver was 1½ feet (45.7 cm) and the minimum distance from the exit of the aerodynamic shield to the receiver was one foot (30.5 cm). Each position produced a ribbon about 20-inches (50.8-cm) wide at a rate of about 170 lbs/hr (77.2 kg/hr). Ribbons produced by succeeding positions overlapped ribbons produced by preceding positions along the moving receiver by about 80%, thereby producing a five-layer sheet which had a unit weight of 1.56 oz/yd$^2$ (52.9 g/m$^2$).

After the sheets were formed, the layers were separated so that the ropiness and weight profile on the individual test ribbons and the ribbons from two typical prior art positions could be analyzed. The following table summarizes the ropiness analysis:

TABLE

| | Test 1 | Test 2 | Average of Two Control Positions |
|---|---|---|---|
| Number of strings | 13 | 19 | 21 |
| Lengths, cm | | | |
| Maximum | 14.0 | 12.7 | 30.5 |
| Average | 8.6 | 8.2 | 14.4 |

As can be seen from the above table, the test ribbons had fewer and shorter string-like formations. In addition to this reduced ropiness, the ribbons of the test position appeared to be more uniform. Also, analysis of the weight distribution across the width of the ribbons indicated that if the test baffle were used in every position of the sheet-making machine, the weight-distribution nonuniformity across the width of the entire sheet would have been reduced by about 35% in comparison to making sheet with the prior-art control baffles. The test baffle produced ribbons with weight distributions across their widths that were significantly less bimodal and less skewed than those produced by the prior-art control baffles.

I claim:

1. In a nonwoven-sheet-making apparatus that has a rotatable baffle for deflecting, spreading and oscillating a fiber stream, means for rotating the baffle, means for forwarding a fiber stream to the baffle, a movable receiver on which the fiber stream can deposit its fibers to form a ribbon which can be lapped with like-formed ribbons to form a sheet, and means for advancing the movable receiver, the baffle having an integral body which includes a boss portion, a flat circular disc portion and a fillet portion, the boss and disc portions having a common axis which is coaxial with the axis of rotation of the baffle, the improvement comprising the fillet portion being a frustum of a cone whose slant surface intersects the boss portion, whose base is parallel to and located atop the flat circular disc portion and whose axis is displaced from the axis of rotation of the baffle.

2. An apparatus of claim 1 wherein the baffle is constructed of a nonconductive plastic.

3. An apparatus of claim 1 wherein the cone is a right cone and the displacement of its axis from the axis of rotation is in the range of 0.5 to 2 cm.

4. An apparatus of claim 3 wherein the displacement is in the range of 0.75 to 1.5 cm.

5. An apparatus of claim 1, 3 or 4 wherein the angle between the slant surface and the base of the cone is in the range of 30 to 60 degrees.

6. An apparatus of claim 1, 3 or 4 wherein the angle between the slant surface and the base of the cone is in the range of 40 to 50 degrees.

* * * * *